United States Patent [19]

Lewis

[11] 4,086,779

[45] May 2, 1978

[54] REFRIGERATION DEFROSTING

[76] Inventor: Roswell E. Lewis, 238 Belleville Turnpike, Kearny, N.J. 07032

[21] Appl. No.: 762,428

[22] Filed: Jan. 25, 1977

[51] Int. Cl.[2] ..... F25D 21/06

[52] U.S. Cl. ..... 62/140; 62/180; 62/282

[58] Field of Search ..... 62/282, 140, 180, 151, 62/82

[56] References Cited

U.S. PATENT DOCUMENTS

| | | | |
|---|---|---|---|
| 3,403,525 | 10/1968 | Beckwith et al. | 62/82 |
| 3,623,334 | 11/1971 | Heidorn | 62/140 |
| 3,937,033 | 2/1976 | Beckwith et al. | 62/282 X |

*Primary Examiner*—William E. Wayner

[57] ABSTRACT

Apparatus is disclosed for automatically defrosting a heat exchange surface of the type that incorporates an evaporator with cooling fins, a refrigerator motor, and a fan to circulate air around the cooling surface of the evaporator to the area to be refrigerated and back again. The defrosting cycle is initiated by pneumatically sensing the air flow restriction caused by frost build up on the evaporators cooling surfaces. The defrosting cycle starts at the optimum time by means of a weight adjustment on a louver device and/or associated part. Then by a novel means, the evaporator area is automatically sealed off from the refrigerated compartment. Simultaneously, warm ambient air, or the like, outside of the refrigerated compartment is introduced into the sealed off evaporator area. This is a definitive, highly efficient circulation path, formed for rapid defrosting purposes, which utilizes the warm ambient outside air, or the like. This air passes around the frosted cooling surfaces of the sealed off evaporator, and back to the outside again. Upon completion of the defrosting cycle normal operation is restored by automatically sealing the defrosting circulation path going to the outside, while simultaneously removing the sealed path between the evaporator and refrigerated compartment. Undesired heat transfer into the refrigerated area, before, during, and after the defrosting cycle is minimal.

1 Claim, 4 Drawing Figures

Fig. 3
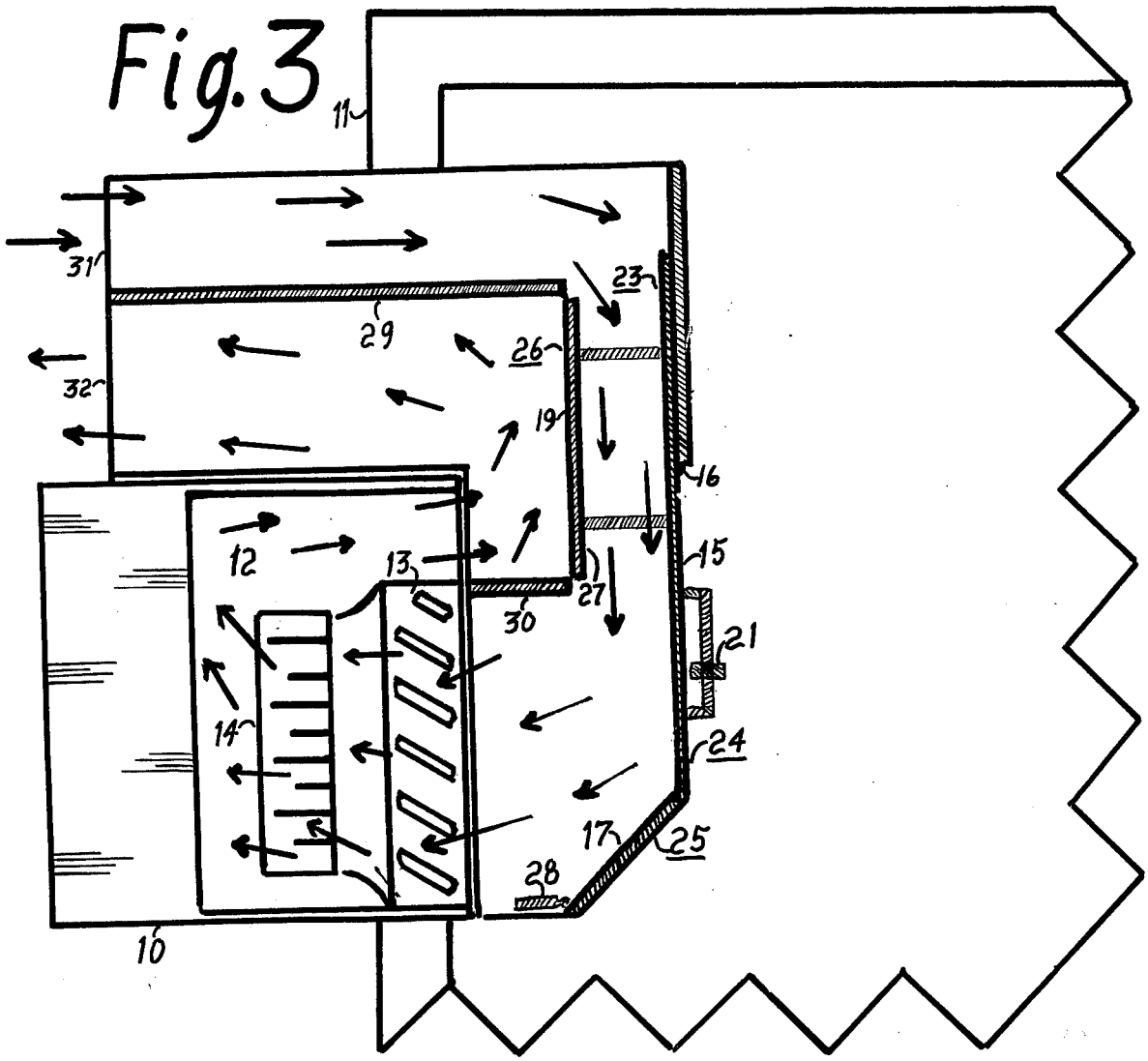
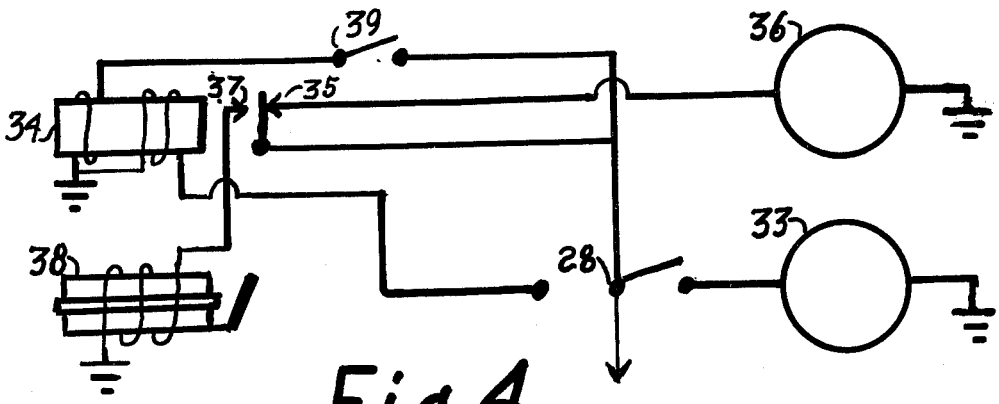
Fig. 4

REFRIGERATION DEFROSTING

This invention relates to an improved means for automatically defrosting a refrigerant apparatus, which utilizes a forced circulation evaporator, and has as its object the provisions of accomplishing this defrosting in a reliable manner, with less energy expenditure, thus a cheaper method, of any defrosting system here-to-fore devised.

It is well known that the building up of frost and ice on the cooling coils and attached fins of a refrigerative evaporator impairs its efficiency. Consequently, many defrosting systems have been devised for ridding the evaporator of the collected frost. None of them are completely satisfactory because all of them require considerable energy expenditure which represents undesirable costs. Furthermore, in all defrosting systems in current use there is undesirable residual heat which enters the refrigerated compartment, representing additional efficiency losses. To combat this situation, attempts have been made to seal off the evaporator area during the defrosting cycle with only partial success. There was still a costly energy requirement. There was an undesirable time lag to convert energy into heat form to melt the frost on the evaporator surfaces. There was still another undesirable time lag to allow the temperature in the sealed off evaporator area to subside before normal refrigeration operation could be effectively resumed.

In my invention I have circumvented the disadvantages of other defrosting systems by utilizing the warm ambient air, or the like, outside of the refrigerated compartment in a most novel and efficient manner. Let us assume that a refrigerated compartment is to be maintained at 34° Farenheit. Let us further assume that the average ambient temperature outside of this refrigerated compartment is 78° Farenheit. This is a temperature difference of 44° Farenheit. This temperature difference is immediately available for defrosting purposes upon initiating of the defrosting cycle at no additional energy cost. The defrosting circulation path is definitive and highly efficient. Upon termination of the defrosting cycle, the warm air path is abruptly and effectively terminated. Residual heat that is transferred into the refrigerated compartment, before, during, and after the defrosting cycle is minimal.

A perusal of the accompanying drawings will show my invention as adapted for use with a self-contained, through-the-wall, or window type air conditioner comfort cooler (hereafter referred to as a comfort cooler). It should be borne in mind that my invention is not limited to this specific equipment, but, with certain obvious modifications, can be utilized with any forced air gasgeous evaporator refrigerative system. This fact will be further developed. My invention offers its greatest commercial value, however, in the adapting of the comfort cooler so it may be effectively utilized for the preservation of food, beverage chilling, and the like. The initial cost of a comfort cooler is approximately one-half that of a commercial refrigerative system of comparative heat removal capacity. Similar savings can be effected in the installation and maintenance areas. The price difference is due, in part, to vast quantity production of the comfort cooler into a highly competitive market, and partly to inherent design differences. For instance, the cooling coil surface area of the comfort cooler evaporator is drastically reduced (as a significant production cost savings) in comparison to that used in commercial refrigeration of similar heat removal capabilities. To compensate for this area reduction the comfort cooler employs radiating fins attached to the evaporator coils that are spaced very close together. This design works satisfactorily at temperatures required for body comfort cooling. However, for the lower temperatures required for refrigeration purposes this design becomes inoperational due to basic frost build up problems. My invention is ideally adapted to overcome this situation. Its efficiency and effectiveness is such that a comfort cooler can be utlized for refrigerative purposes in lieu of a convential commercial refrigerative system of comparative heat removal capabilities.

In the accompanying drawings one form of this invention is illustrated:

FIG. 3 is the same view as in FIG. 2 with the louver closed while in the defrosting cycle.

FIG. 4 is one of several obvious practical electrical circuitry combinations that would enable the device to be brought out of the defrosting cycle and back into normal refrigerative operation.

Figure 1:
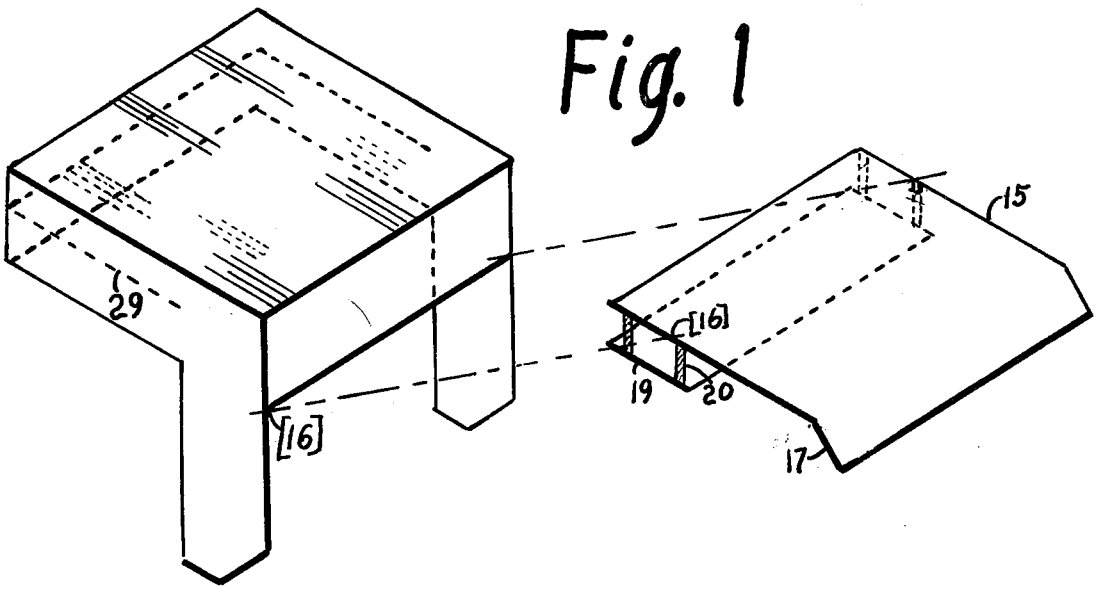
FIG. 1 is a simplified isometric view with the louver assembly exploded, of a device constructed in accordance with this invention as adapted for use with a self contained, through-the-wall, or window type, comfort cooler.
Figure 2:
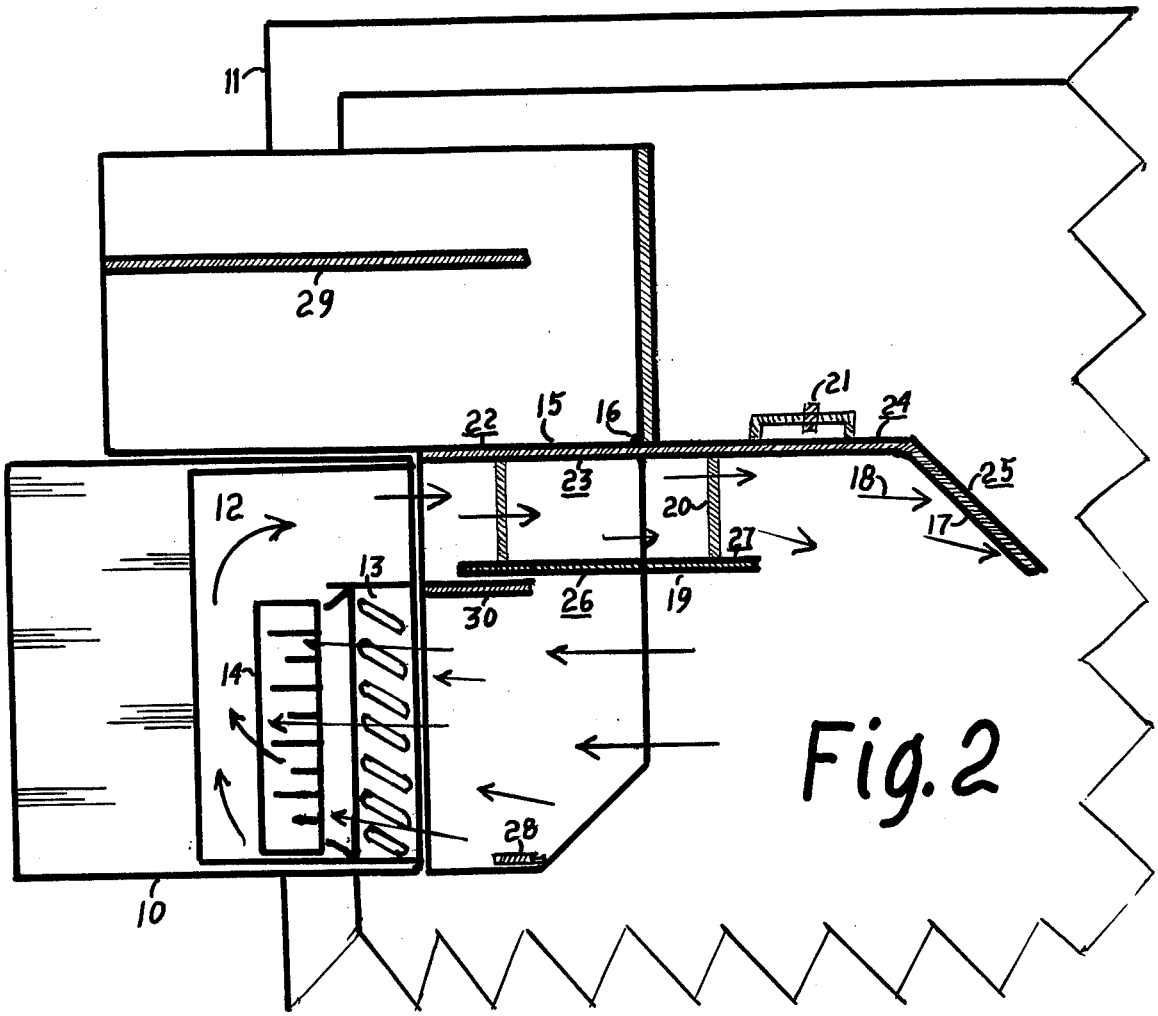
FIG. 2 is a vertical cross section view of the device attached to the evaporator section of a comfort cooler with the louver open in the normal operating cycle.

Referring to FIG. 1, the preferred embodiment of my invention; the purpose of this isometric drawing is to give the viewer a three-dimensional concept of the device when perused in conjunction with FIG. 2 and FIG. 3. FIG. 2 depicts a self-contained comfort cooler 10 mounted through the wall 11 of a cut-away portion of a refrigerated compartment. The evaporator section 12 of the comfort cooler is cut-away to show the evaporator coils 13 and the evaporator circulation fan 14. My rapid defrost adapter device is shown attached to the evaporator end of a comfort cooler in such a manner that the upper left portion of the device protrudes through wall 11 extending outside of the refrigerated compartment. Louver 15 is attached to the device by pivotal means 16. 17 is that portion of the louver 15 that offers an air current 18 deflecting surface. Plate 19 is in the same plane as the major surface area of louver 15, and is attached to louver in a fixed position by means of supports 20. Louver 15 is so weighted that it is in a nearly balanced condition. If the evaporator circulation fan 14 were not operating that portion of louver between pivotal point 16 and deflector surface 17 would slowly descend from its horizontal position. However, with the circulation fan 14 on, with little or no frost build up on the cooling surfaces of evaporator 13, the velocity of the evaporators forced air circulation current 18 striking louver deflecting surface 17 is such that louver 15 will remain in the horizontal position. This is the normal refrigerative or operating cycle. The defrosting cycle can be accuated at the optimum time with the aid of adjustable weight 21. The optimum time is, obviously, when the air flow around and through the evaporators cooling surfaces is restricted due to frost build up to the extent that refrigerative operation is no longer efficient. This restricted air flow striking the louver deflecting surface 17 at a reduced velocity will cause the louver to dip. With the evaporator circulation fan on, a slight dip of louver 15 will create significant air current 18 pressures on louver and plate 19 in the general areas depicted by 22, 23, 24, 25, 26 and 27. As the louver dips these pressures are exerted in an ever increasing and accelerated manner. Therefore, the dipping of the louver is not slow and gradual as may be persumed, but because of the foregoing aerodynamic characteristics the transition from the normal operating cycle (louver fully open) to the defrosting cycle (louver completely closed) occurs with efficient rapidity. It may be significant to note that this cycle transition can occur with minimum electrical and/or electronic circuitry involvement.

Referring to FIG. 3, depicting the defrosting cycle: Louver upon closing accuates a double throw switch 28 which cuts off the compressor motor (not shown) to insure, for obvious reasons, that there will be no refrigerative operation while in the defrosting cycle. The double throw switch when accuated by the closing of the louver also energizes an adjustable delay latching relay (not shown in FIG. 3) whose purpose is as an aid to bring device out of the defrosting cycle and back into normal operation at the proper time. Its mode of operation will be explained later. A careful examination of FIG. 3 will now show that we have a novel and highly efficient method of accelerated defrosting. The functions of plate 19 are three-fold; while in normal operation it served as a stablizing aid; between cycles, while louver was closing, plate 19 accelerated this transition due to aerodynamic reasons. Now that the device is in the defrosting cycle, plate 19 forms a part of the defrosting duct partition composed of parts 19, 29 and 30. With the evaporator circulation fan 14 on, the defrosting circulation is of high velocity, definitive, and very effective. Warm ambient air, or the like, from outside the refrigerated compartment, enters the circulation duct intake 31. It goes down to the evaporator area, around and through the evaporators 13 cooling surfaces, and to the outside again through the circulation duct outlet 32. The defrosting process is exceedingly rapid. The exact time may vary between one and three minutes due to such factors as humidity and ambient air, or the like, temperature. During the entire defrosting cycle, louver 15 remains securely closed due to aerodynamic pressures exerted in the general louver areas of 23, 24, 25, 26 and 27. Thus, there is no appreciable undesired heat transfer into the refrigerated compartment.

FIG. 4 shows one of many obvious possible and practical electrical and/or electronic circuitry combinations to enable the device to go from the defrosting cycle to the normal refrigerative operation cycle. Closing of louver 15 energizes single-pole, double-throw switch 28. This insures that the compressor motor 33 remains off during the defrosting cycle. Switch 28 also energizes an adjustable (1 to 3 min.) time delay latching relay 34. At the end of the defrosting cycle contact 35 opens which cuts off evaporator fan motor 36. This action is desirable to enable louver 15 to be easily accuated (louver is in a nearly balanced state but held securely closed by aerodynamic pressures when evaporator fan 14 is on). With the accuating of relay 34 contact 37 is closed and relay contacts are latched. The closing of contact 37 energized electro-magnet 38 which raises louver to the horizontal (normal operating cycle) position. As the louver leaves its closed (vertical) position, the single-pole, double-throw switch 28 is reversed which deenergizes the time delay coil on time delay latching relay 34 and energizes the compressor motor 33. As the louver almost reaches its horizontal position it trips switch 39 which mementarily energizes the delatching coil on relay 34. This delatches contacts of relay 34, thereby deenergizing electro-magnet 38 and energizing evaporator fan motor 33. This completes the defrosting cycle, returning the unit to normal refrigerative operation.

While the preferred embodiment of the invention has been disclosed, other forms may be used, all coming within the scope of the claimed subject matter which follows.

What is claimed:

1. In a defrosting system utilizing ambient air as the defrosting medium for refrigeration system having an air cooling evaporator, blower means operating in a normal cooling cycle to take air from a cooled compartment, pass it over the evaporator and thence back to the compartment, a defrosting means which changes the air flow in the defrost made by using the blower to take ambient air from outside the compartment, direct it past the evaporator to provide the desired defrosting action and direct the air back to the ambient: the improvement in the defrosting means comprising air director which simultaneously functions as a frost build-up sensor and an arrangement for directing air in the cooling cycle mode or in the defrost mode, said air director being movably mounted in the outlet air stream from the blower means and being so arranged as to sense reduced air flow over the evaporator due to frost build-up, said air director upon sensing the need for defrost automatically moving from the cooling mode position to a defrost position thereby providing ambient air flow over the evaporator to provide defrosting and means responsive to the position of the air director to disable the evaporator during defrosting and to restore the evaporator at the termination of the defrosting.

* * * * *